United States Patent [19]

Nakajima et al.

[11] 4,398,816

[45] Aug. 16, 1983

[54] ELECTROPHOTOGRAPHIC COPYING PRINTER

[75] Inventors: Junzo Nakajima, Kawasaki; Masatoshi Kimura; Tadashi Matsuda, both of Yokohama, all of Japan

[73] Assignee: Fujitsu Limited, Kawasaki, Japan

[21] Appl. No.: 299,793

[22] Filed: Sep. 4, 1981

Related U.S. Application Data

[63] Continuation of Ser. No. 65,869, Aug. 13, 1979, abandoned.

[30] Foreign Application Priority Data

Aug. 18, 1978 [JP] Japan ..... 53-99949

[51] Int. Cl.[3] ..... G03G 15/01; G03G 15/04; G03G 15/28

[52] U.S. Cl. ..... 355/3 R; 355/4; 355/7

[58] Field of Search ..... 355/1, 3 R, 4, 14 R, 355/7

[56] References Cited

U.S. PATENT DOCUMENTS

| | | | |
|---|---|---|---|
| 3,960,445 | 6/1976 | Drawe | 355/4 |
| 4,124,286 | 11/1978 | Barasch | 355/3 R |
| 4,166,691 | 9/1979 | Ebi et al. | 355/11 |
| 4,167,324 | 9/1979 | Wu | 355/3 R |
| 4,251,152 | 2/1981 | Miyakawa et al. | 355/3 R |

*Primary Examiner*—Fred L. Braun
*Attorney, Agent, or Firm*—Daniel Jay Tick

[57] ABSTRACT

First and second optical latent image forming devices form an electrostatic latent image directly on a homogeneously charged recording medium surface. Each of the first and second optical latent image forming devices has the capability of discharging almost half the initial charges of the recording medium. The discharging effect of the first and second optical latent image forming devices forms the combined electrostatic latent image.

9 Claims, 17 Drawing Figures

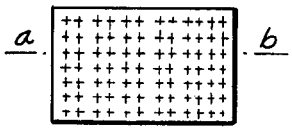
FIG. 2a
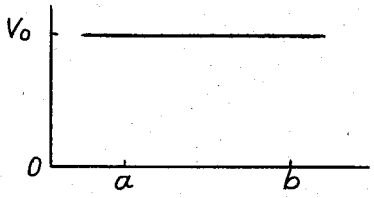
FIG. 2b
FIG. 3a
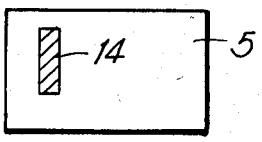
FIG. 3b
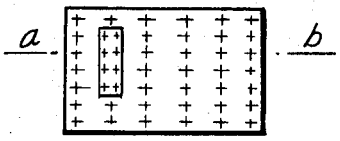
FIG. 3c
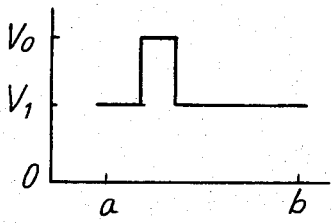

FIG.4a
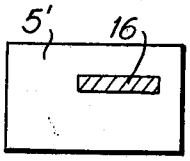
FIG.4b
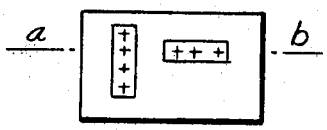
FIG.4c
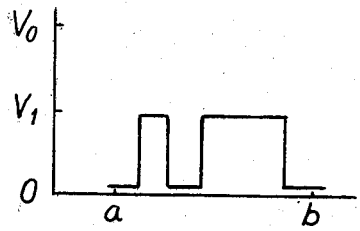
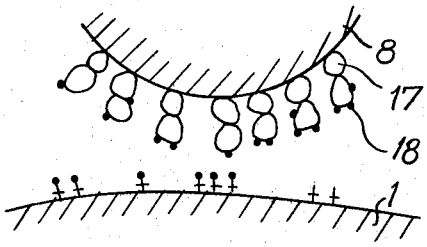
FIG.5
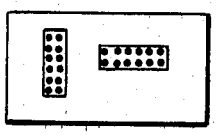
FIG.6

ELECTROPHOTOGRAPHIC COPYING PRINTER

BACKGROUND OF THE INVENTION

Field of the Invention

This is a continuation of application Ser. No. 065,869, filed Aug. 13, 1979, now abandoned.

The present invention relates to an electrophotographic copying printer. More particularly, the invention relates to the electrostatic latent image forming process of an electrophotographic recording system having copying and printing functions.

Description of the Prior Art

Due to the rapid improvement in the operating speeds of computer systems, an output device such as a line printer must meet requirements which insure high speed printing, must be small in size and simple in structure for easy maintenance, and must have a low noise level. In order to meet these requirements, investigation continues dynamically for a printer of non-impact type. Various types of non-impact printers are well known. These include the electrostatic printer, electrophotographic printer, ink-jet printer, ink-mist printer and thermal printer, etc.

More particularly, a maximum effort has recently been made to develop a electrophotographic printer which generates images through the scanning of a laser beam, because it is very convenient for high speed printing.

In the image recording process of an electrophotographic printer, the surface of a recording medium consisting of photoconductive material is first homogeneously charged by a corona discharge. The recording medium is then exposed to the light from the original paper. Thereafter, charges on the exposed area are eliminated in accordance with the original image and such area is maintained almost at zero potential. The latent image may thereby be formed. The electrostatic latent image is then converted into a visible image by tinting impalpable powder at the developer. This visible image is transferred to the paper and then fixed by heating. Paper copies may thus be obtained.

This image recording process is called the Carlson process, and recording devices utilizing such process have been in practical use for a long period of time.

On the other hand, there is a growing need for an electrophotographic printer having a so-called Forms Overlay function, in which characters are written in the blank space of the paper copy or copying paper provided by the electrophotographic copying device. However, the blank space of the paper copy corresponds to the exposed area of the recording medium in the copying device. Therefore, this area is discharged and maintained at almost zero potential. It is thus impossible to form the latent image of characters to be written even if this area is irradiated by a laser beam from the data writing part of the printer. For this reason, in the presently proposed electrophotographic printer, which combines copying and printing devices, the latent image is formed by the following process. A negative image is used as the original draft so that the surface of recording medium which corresponds to the blank space during exposure is kept in the charged condition and at the specified potential level. The charge of this area is thereafter discharged, corresponding to the characters to be written, by irradiating this area with the laser beam from the data writing part of the printer.

An electrophotographic printer having the Forms Overlay function is described, for example, in an article entitled, "Electrophotographic Process in a High Speed Printer", IBM Journal of Research and Development, Vol. 22, No. 1, Jan. 1978, pages 34 to 39, and in an article entitled, "Principles of a High-Speed Non-Impact Printer", The Journal of Photographic Science, Vol. 25, 1977, pages 186 to 188. However, it is impossible to directly use ordinary printed matter in the electrophotographic printer of this type, described in these references. More particularly, printed matter in which positive images are printed as the copying draft, and therefore printed matter in which positive images are reprinted into negative images, must be prepared as the copying draft.

As a result, the provision of a copying draft having negative images requires longer time and processes. This is especially true when the foregoing processes utilize various types of copying drafts. Each positive image must then be converted to a negative image for all copying drafts, and this is very inconvenient in practical use.

The principal object of the invention is to provide an electrophotographic copying printer which permits the writing of images such as characters into the blank space or spaces of copying paper by utilizing a copying draft having positive images.

BRIEF SUMMARY OF THE INVENTION

The electrophotographic copying printer of the present invention overcomes the disadvantages of the aforedescribed known electrophotographic printers. More particularly, in an electrophotographic printer having a plurality of latent image forming devices for the recording medium, said recording medium is homogeneously charged at its surface. The latent image forming device which first records data in the recording medium partly eliminates remaining charges on the surface of said medium, so that the next latent image forming device is capable of recording data and the succeeding latent image forming devices eliminate the remaining charges on said surface. In this manner, the recorded or written and combined latent images may be respectively provided by the plurality latent image forming devices.

It is thereby possible to record or write desired images such as characters in the blank space of the copying paper, even when the original copying draft having positive images is used directly.

BRIEF DESCRIPTION OF THE DRAWINGS

In order that the invention may be readily carried into effect, it will now be described with reference to the accompanying drawings, wherein:

FIG. 2*a* is a schematic diagram of the charge distribution on the recording drum of the printer of FIG. 1, charged uniformly;

FIG. 2*b* is a graphic presentation of the potential level of the recording drum of the printer of FIG. 1, charged uniformly;

FIG. 3*a* is a schematic diagram of the copying draft of the printer of FIG. 1, including images and a blank space;

FIG. 3*b* is a schematic diagram of the charge distribution of the recording drum surface after exposure for copying;

FIG. 3*c* is a graphical presentation of the potential level of the recording drum surface after exposure for copying;

FIG. 4*a* is a schematic diagram of the image area exposed for recording;

FIG. 4*b* is a schematic diagram of the charge distribution of the recording drum surface after exposure for recording;

FIG. 4*c* is a graphical presentation of the potential level of the recording drum surface after exposure for recording;

FIG. 5 is a schematic diagram, on an enlarged scale, of part of the magnetic brush of FIG. 1 for developing;

FIG. 6 is a schematic diagram of the recording image of FIG. 4*b*, having toner coated on the latent image after it has passed the magnetic brush developing device of FIG. 1;

DETAILED DESCRIPTION OF THE INVENTION

Figure 1:
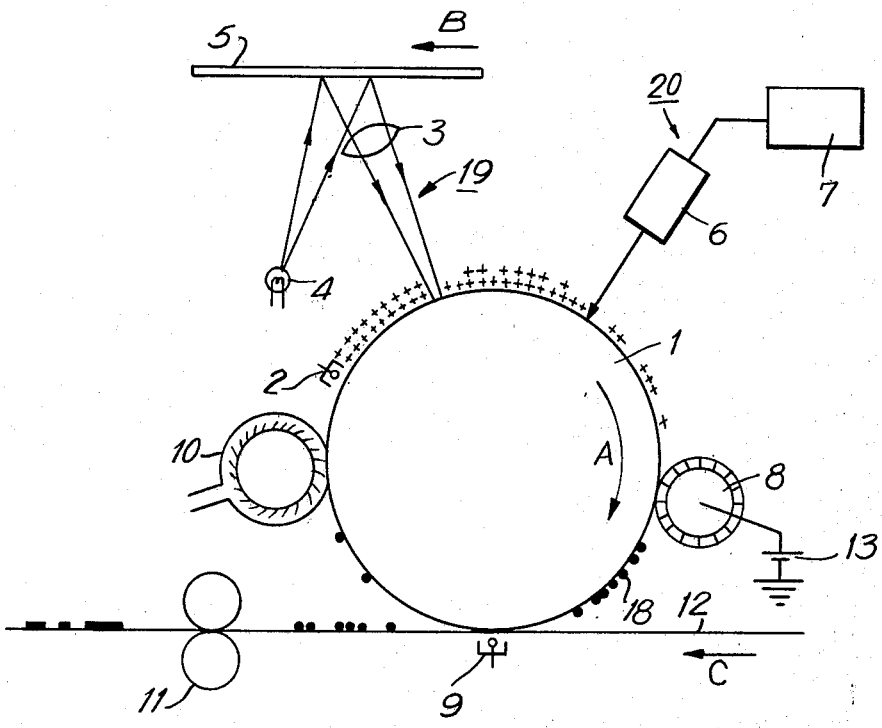
FIG. 1 is a schematic diagram of an embodiment of the electrophotographic copying printer of the invention.

FIG. 1 is a configuration of an embodiment of the electrophotographic copying printer of the present invention. The corona discharger 2 for uniform charging, exposure device 19 for copying, optical system 20 for data recording or writing, magnetic brush development device 8 for developing, corona discharger 9 for transfer and cleaner 10 are arranged along the circumference of the recording drum 1. The photoconductive material such as, for example, selenium, is provided on the surface of the recording drum 1.

Each of the devices 2, 19, 20, 8, 9 and 10 arranged along the circumference of the recording drum 1, is well known and established technically. Therefore, the devices 2, 19, 20, 8, 9 and 10 are not described herein.

The printer of FIG. 1 includes the copying draft 5 on which the positive image is printed, the transfer or copying paper 12 which is called plain paper, the fixing roller 11 and the developing agent or toner 18. In addition, the exposure device 19 for copying is composed of the light source 4 and the optical system such as, for example, the lens 3.

The optical system 20 for recording data input is composed of the laser beam generator and optical system 6 and the print control circuit 7. The luminous intensity of the light source 4 is predetermined to provide sufficient exposure for eliminating almost half the homogeneous charge provided by the corona discharger 2.

In the same manner, the amount of irradiation of the laser beam produced by the laser beam generator and optical system 6 of the optical device 20 for recording data input is predetermined to eliminate almost half the homogeneous charge provided on the photoconductive material on the recording drum 1 by the corona discharger 2.

The recording operation of the electrophotographic copying printer of the embodiment of FIG. 1 of the invention is as follows.

The recording drum 1 is rotated in the direction indicated by the arrow A by a motor (not shown in the FIGS.) and the photoconductive material on the surface of said recording drum is homogeneously charged by the corona discharger 2, which is positioned in close proximity with said recording drum. The homogeneously charged surface of the recording drum 1 is then exposed to the light from the exposure device 19 for copying the original paper 5. At this time, the surface potential of the recording drum 1 is attenuated to almost half the surface potential due to first homogeneous charging at the area exposed to the light from the exposure device 19 for copying and is maintained at such a surface potential due to the first homogeneous charging at the other areas, more specifically, the area not exposed.

The laser beam corresponding to characters or signs to be printed from the optical system 20 for recording data input then irradiates the surface of the recording drum 1. As hereinbefore mentioned, since the intensity of the laser beam is predetermined to an extent sufficient to eliminate almost half the homogeneous charge on the recording drum, the surface potential of the area irradiated by the laser beam is uniformly attenuated. Only the surface potential of the area corresponding to the characters or signs which are not irradiated by the laser beam is not attenuated and is maintained at a value after passing the exposure device 19, that is, at a potential almost half the surface potential when the surface is homogeneously charged at first by the corona discharger 2. At this time, the surface potential of the area not exposed by the exposure device 19 decreases due to irradiation by the laser beam. However, since such area is maintained at the surface potential to which it is charged by the corona discharger 2 the first time, the surface potential does not become zero and is maintained at almost half the initially charged potential.

A positive latent image, which is a combination of the image corresponding to the original draft and the image corresponding to characters and signs due to the laser beam, is provided on the recording drum 1 by two exposures effected by the exposure device 19 for copying and the optical device 20 for recording data input.

The latent image formed on the recording drum 1 is then converted to a visible image by coating with the toner which has a negative charge provided by the magnetic brush development device 8 for developing.

The visualized toner image on the recording drum is pressed to the copying paper 12 in the next transfer step and is electrostatically adhered to said copying paper due to the positive charge applied from the rear side of said copying paper by the corona discharger 9 for image transfer.

The toner image generated on the copying paper 12 is heated, pressed and fixed on the copying paper 12 by the fixing roller 11. A small amount of toner left on the recording drum 1 after the transfer step is mechanically eliminated by the cleaner 10, which uses a fur brush.

The printing steps of the electrophotographic copying printer of the invention are hereinbefore explained. The latent image providing process is hereinafter explained with reference to FIGS. 2*a*, 2*b*, 3*a*, 3*b*, 3*c*, 4*a*, 4*b* and 4*c*.

The photoconductive material at the surface of the recording drum 1 is homogeneously charged at +1200 V by the corona discharger 2 when selenium sensitive material is used, for example. FIGS. 2*a* and 2*b* show the charging condition of the recording drum 1 at such time. FIG. 2*a* shows the charge distribution condition of the area corresponding to the copying draft or original paper 5 on the recording drum 1. The potential level between points a and b of FIG. 2*a* uniformly becomes $V_0$, which is, for example, +1200 V, as shown in FIG. 2*b*.

The copying surface of the original paper 5 is successively irradiated by the light emitted from the light source 4 of the exposure device 19 for copying and the homogeneously charged surface of the recording drum is exposed to the light reflected from said copying surface via the optical system 3. The surface of the recording drum 1 corresponding to the space other than the image 14 of the original paper 5 shown in FIG. 3*a* is therefore exposed and the charge of this area is eliminated almost half. FIG. 3*b* graphically shows the charge distribution at this time.

As shown in FIG. 3*c*, the potential level of the area corresponding to the image area 14 between the points a and b is maintained at $V_0$ and that of the space other than the aforementioned areas is decreased to $V_1$. At this time, since the magnitude of the exposure is predetermined to an extent sufficient to eliminate the charge corresponding to almost half the potential level of the homogeneously charged potential, $V_1$ becomes almost equal to $\frac{1}{2} V_0$, so that $V_1 \approx \frac{1}{2} V_0$, about 600 V in this case.

As hereinbefore explained, the latent image corresponding to the image area 14 on the copying draft 5 is formed on the recording drum 1. In the next step, the write command for instructing to record or write image 16 of characters or signs into the area 5', corresponding to the original paper 5, is issued as shown in FIG. 4*a*. This command comes, for example, from the print control circuit 7 of the optical device 20 for recording data input. When this command signal is issued, the surface of the recording drum 1 is positively exposed in accordance with the image 16 to be printed by the laser beam generator and optical system 6. At this time, since the intensity of the laser beam irradiation is predetermined, as described, to a value sufficient to eliminate the charge corresponding to almost half the homogeneously charged potential, or 1200 V in the present example, the potential of the latent image corresponding to the image area of the original paper in the preceding stage decreases to 600 V from 1200 V. The potential of the area corresponding to the image 16 of the optical device 20 for recording data input is maintained at 600 V and the potential level of the other space decreases almost to zero.

The charge distribution at this time is shown in FIG. 4*b*, and the potential level is shown in FIG. 4*c*. After the latent image is provided by the exposure device 19 for copying, as hereinbefore described, the latent image corresponding to the signs 16 may be recorded in the space of the original paper by the optical device 20 for recording data input. The potential level of both latent images becomes equal to $V_1$, which is about 600 V.

Thereafter, as hereinbefore explained, the negatively charged toner or tinting impalpable powder coated on the carrier 17 in the magnetic brush development device 8 for developing is adhered by the electrostatic force to the latent image of the recording drum 1 as shown in FIG. 5, thereby providing a visible image. The visible image on the recording drum 1 at this time is shown in FIG. 6. The toner 18 on the recording drum 1 is then adhered to the copying paper 12 by the corona discharger 9 for image transfer, so that the toner image is transferred to said copying paper. The transferred image is successively heated, pressed and fixed on the copying paper 12 in the fixing part consisting of the heated roller 11.

Figure 7:
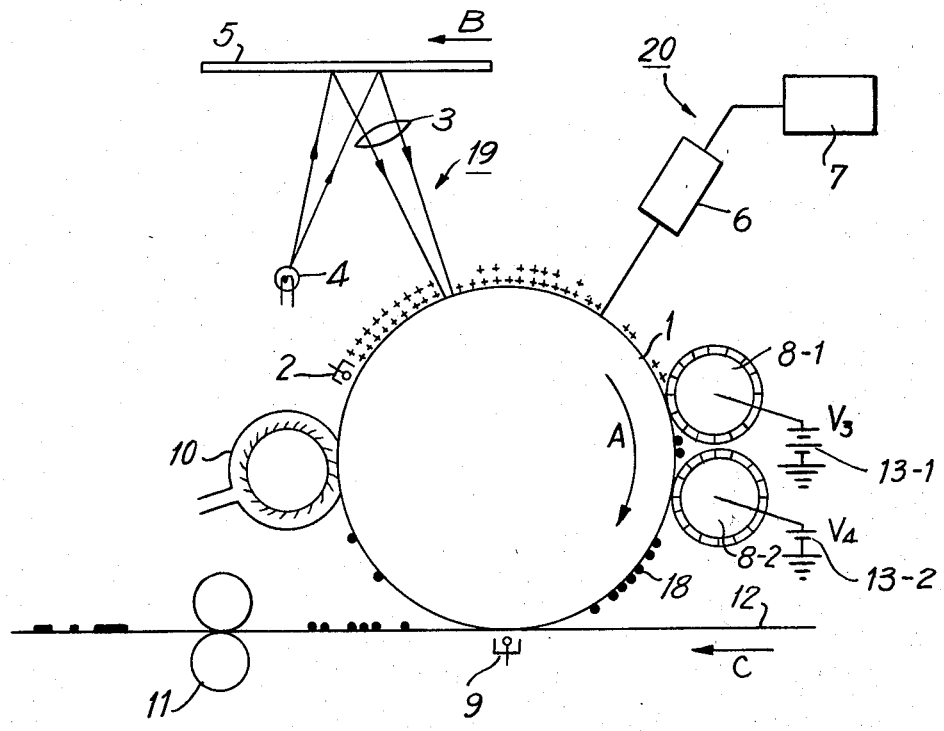
FIG. 7 is a schematic diagram of another embodiment of the electrophotographic copying printer of the invention functioning as a multicolor printer.

FIG. 7 is a configuration of another embodiment of the electrophotographic copying printer of the present invention, which functions as a multicolor copying printer.

In the embodiment of FIG. 7, the aforedescribed latent image formation process of the invention is adapted to a multicolor copying printer. The configuration of the embodiment of FIG. 7 is similar to the embodiment of FIG. 1. The only difference between the two embodiments is the image developing part. More particularly, the embodiment of FIG. 7 is different from the embodiment of FIG. 1, because the developing part of FIG. 7 is composed of first and second magnetic brush development devices. The conductive axis of the first magnetic brush development device 8-1 is connected to a positive power supply 13-1 which supplies a developing bias voltage $V_3$. The conductive axis of the second magnetic brush development device 8-2 is connected to a positive power supply 13-2 which supplies a developing bias voltage $V_4$.

Figure 8A:
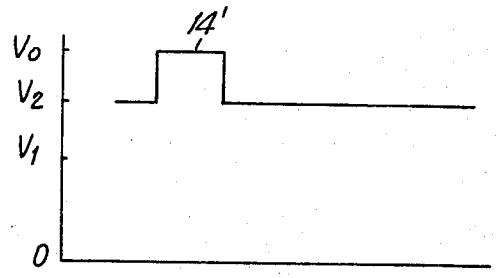
FIG. 8*a* is a graphical presentation of the potential level of the recording drum surface charged uniformly after exposure for copying.

The operation of the embodiment of FIG. 7 is explained with reference to FIGS. 8*a* to 8*e*. First, the surface of the photoconductive material of the recording drum 1 is homogeneously charged by the corona discharger 2. The charging condition of the recording drum 1 at this time is shown in FIG. 2*a*. The homogeneously charged surface of the recording drum 1 is then exposed by the exposure device 19 for copying, whereby the surface potential of said recording drum corresponding to the space other than the image area 14 of the original paper is attenuated to $V_2$, as shown in FIG. 8*a*. The surface potential $V_2$ is set to an interim value between the first homogeneously charged potential $V_0$ and the interim potential $V_1$ of potential $V_0$ and zero potential.

Figure 8B:
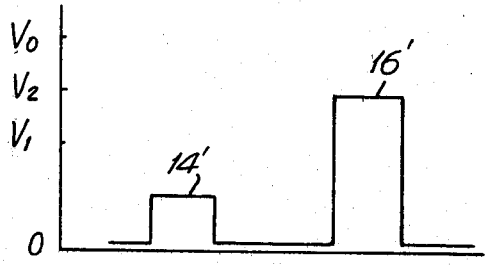
FIG. 8*b* is a graphical presentation of the potential level of FIG. 8*a* after exposure for recording.

The areas other than those corresponding to the images of characters and signs, etc. are then irradiated by the laser beam emitted from the optical device 20 for recording data input. At this time, since the intensity of irradiation of the laser beam is predetermined to an extent sufficient to eliminate the charge corresponding to a level of surface potential $V_2$, the potential level on the recording drum after irradiation by the laser beam becomes almost zero potential, as shown in FIG. 8*b*, in every area, except for the image area 14' corresponding to the original paper in the preceding stage and the image area 16' corresponding to printing information not irradiated by the laser beam. The potential levels of the two areas 14' and 16' are different.

Figure 8C:
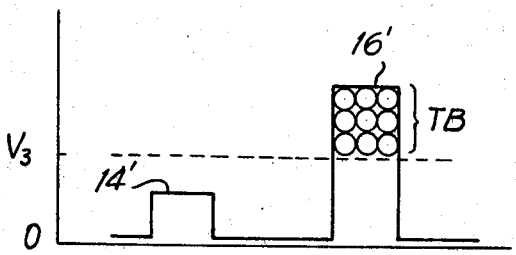
FIG. 8*c* is a graphical presentation of the potential level of the recording drum surface after development by the magnetic brush to which a development bias voltage $V_3$ is applied.

The latent image combined in this manner is then visualized in the developer. The first magnetic brush development device 8-1 providing the developer has negatively charged black toner TB and the developing bias voltage $V_3$ is applied thereto from the power 13-1. The potential $V_3$ is predetermined to a level lower than the potential level of the image area 16', corresponding to the printing information, but higher than the potential level of the image area 14', corresponding to the original paper. Therefore, the black toner TB supplied by the first magnetic brush development device 8-1 is coated only on the image area 16', corresponding to the printing information, as shown in FIG. 8*c*.

Figure 8D:
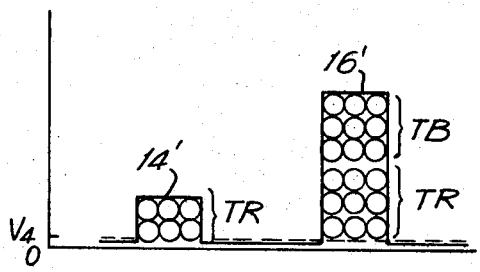
FIG. 8*d* is a graphical presentation of the potential level of the recording drum surface after development by the magnetic brush to which a development bias voltage $V_4$ is applied.
Figure 8E:
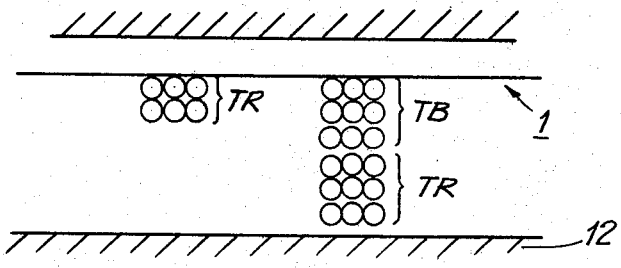
FIG. 8*e* is a schematic diagram of the profile of the visualized combination image formed on the recording drum and duplicated on the copying paper.

The second magnetic brush development device 8-2, providing the developer in a similar manner, has negatively charged red toner TR and the developing bias voltage $V_4$ is applied thereto from the power supply 13-2. The potential $V_4$ is predetermined to a level lower than any potential levels of the image area 16', corresponding to the printing information, and the image area 14', corresponding to the original paper. Therefore, the red toner TR supplied by the second magnetic brush development device 8-2 is coated on both the image area 16', corresponding to the printing information, and the image area 14', corresponding to the original paper, as shown in FIG. 8*d*.

The combined image visualized by two kinds of toners having different colors, as hereinbefore explained, is pressed to the copying paper 12 in the image transfer part and electrostatically adhered and transferred to the copying paper 12 from the recording drum 1 by the charge provided by the corona discharger 9 for image transfer and supplied from the rear side of the copying paper 12. The toner image on the copying paper 12 generated after the image transfer step is composed of the red toner TR, coated on the image area 14' and corresponding to the copying draft, and the black toner TB, coated on the image area 16' and corresponding to the printing information. The red toner TR is also coated, in addition to the black toner TB, on the image area 16' corresponding to the printing information, but since the black toner TB is superior to the red toner, there is no chance that the area looks red. When it is necessary to particularly emphasize the printing of black in the image area 16', the developing bias voltage is set low in order to increase the amount of black toner coated, or a black toner which emphasizes black is selected.

In the embodiment of FIG. 7, the form of original draft and characters or signs written by the laser beam can be recorded in different colors, so that the printer of the invention is very effective when it is utilized to record slips, etc.

If it is necessary to change the color between the desired area and other areas of the form on the original copying draft, image information corresponding to the original copying draft of two levels may be recorded or written on the recording drum in accordance with difference of the reflected light beam by previously printing the form in the original copying draft in a color having different reflection coefficient. It is thus also possible to obtain a recorded image of three colors by, for example, providing three types of magnetic brush development devices for developing and applying three kinds of developing bias voltages to each of them, respectively.

In the electrophotographic copying printer of the present invention, as hereinbefore explained, the optical device for recording data input is positioned after the exposure device for copying. Thus, the printing of characters, etc. may be provided in the space of the original copying draft by using an ordinary original copying draft having positive images. It is possible to change the position sequence of the optical device for recording data input and the exposure device for copying. The recording drum surface is described as being homogeneously charged positively. However, the invention is not so limited, and the drum surface may be charged negatively.

Furthermore, although the type of developing agent is described as a two component development powder consisting of a carrier and a toner, it is possible to use a single component toner such as, for example, a magnetic toner, etc.

Additionally, the optical device for recording data input may utilize a laser beam scanning optical system, an OFT recording tube, or a laser diode.

Although the recording of the combined image of the printing information written by the laser beam and the copying of information written by the exposure of the original copying draft is described, it is, of course, possible to record only the printing information or copying information. The following three procedures may be utilized for recording only the printing information or copying information.

1. A method where the latent image is obtained by setting the homogeneously charged potential to almost half the charged potential in order to obtain the combined image.

2. A method where homogeneous charging is performed by setting the charged potential in the homogeneous charging step in the same manner as the charged potential for obtaining the combined image. The image corresponding to the printing information or copying information is irradiated or exposed, almost half the initial charged potential is eliminated, and the developing bias voltage, which is almost half the initial charged potential, is applied for developing in the developer.

3. A method where the homogeneous charging is performed with the same charging potential as that for obtaining the combined image in the initial charging process. The charged potential is then attenuated to almost half the initial charged potential by the exposure of the entire part. Thereafter, the image corresponding to the printing information or copying information is irradiated or exposed, whereby the latent image may be provided and, on the contrary, the image is exposed and thereafter the entire part is exposed.

The first procedure may provide a long service time, because the initial charged potential is set almost to half that for obtaining the combined image from the beginning, and fatigue of the photoconductive material of the recording drum may be particularly lessened. Furthermore, the first procedure provides easier control and other effects in comparison with the second and third procedures.

While the invention has been described by means of specific examples and in specific embodiments, we do not wish to be limited thereto, for obvious modifications will occur to those skilled in the art without departing from the spirit and scope of the invention.

We claim:

1. An electrophotographic copying printer having a homogeneously charged recording medium surface, said copying printer comprising first and second optical latent image forming devices for forming an electrostatic latent image directly on said recording medium surface, each of said first and second optical latent image forming devices having the capability of discharging almost half the initial charges of said recording medium and the discharging effect of said first and second optical latent image forming devices forming the combined electrostatic latent image, said first optical latent image forming device discharging almost half said recording medium having the initial capability of the background, except for the image portion to be formed by said first optical latent image forming device in order to form a latent image on said homogeneously charged recording medium surface and said second optical latent image forming device discharging almost half said recording medium having the initial capability of the background, except for the image portion to be formed by said second optical latent image forming device in order to form a latent image on the latent image formed on said recording medium surface by said first optical latent image forming device.

2. An electrophotographic copying printer as claimed in claim 1, wherein said recording medium comprises photoconductive material, said first optical latent image forming device comprises an exposure type copying and recording device and said second optical latent image forming device comprises an optical device for recording data input.

3. An electrophotographic copying printer as claimed in claim 2, wherein said optical device for recording data input consists of a scanning optical device.

4. An electrophotographic copying printer as claimed in claim 2, wherein said optical device for recording data input consists of optical fiber recording tubing.

5. An electrophotographic copying printer as claimed in claim 2, wherein said exposure type copying and recording device includes means for exposing said recording medium with light reflected from the original copying draft.

6. An electrophotographic copying printer as claimed in claim 2, wherein said exposure type copying and recording device includes means for exposing said recording medium with transparent light from the original copying draft.

7. An electrophotographic copying printer as claimed in claim 1, wherein said recording medium comprises photoconductive material, said first optical latent image forming device comprises an optical device for recording data input and said second optical latent image forming device comprises an exposure type copying recording device.

8. An electrophotographic copying printer as claimed in claim 7, wherein said optical device for recording data input consists of a laser beam scanning optical device.

9. An electrophotographic copying printer as claimed in claim 7, wherein said optical device for recording data input consists of optical fiber recording tubing.

* * * * *